US008508424B2

(12) United States Patent
Timofeev et al.

(10) Patent No.: US 8,508,424 B2
(45) Date of Patent: Aug. 13, 2013

(54) DUAL BAND BASE STATION ANTENNA

(75) Inventors: Igor E. Timofeev, Dallas, TX (US); Eddie Ray Bradley, Richardson, TX (US)

(73) Assignee: Andrew LLC, Hickory, NC (US)

( * ) Notice: Subject to any disclaimer, the term of this patent is extended or adjusted under 35 U.S.C. 154(b) by 365 days.

(21) Appl. No.: 12/671,460

(22) PCT Filed: Nov. 27, 2009

(86) PCT No.: PCT/US2009/066016

§ 371 (c)(1), (2), (4) Date: Nov. 11, 2010

(87) PCT Pub. No.: WO2010/063007

PCT Pub. Date: Jun. 3, 2010

(65) Prior Publication Data

US 2011/0043425 A1 Feb. 24, 2011

Related U.S. Application Data

(60) Provisional application No. 61/118,328, filed on Nov. 26, 2008.

(51) Int. Cl.
*H01Q 21/00* (2006.01)

(52) U.S. Cl.
USPC ..... 343/817; 343/818; 343/810

(58) Field of Classification Search
USPC ..... 343/797, 810, 812, 813, 817, 818
See application file for complete search history.

(56) References Cited

U.S. PATENT DOCUMENTS

| | | | | |
|---|---|---|---|---|
| 6,816,124 | B2 * | 11/2004 | Tillery | 343/797 |
| 6,924,776 | B2 | 8/2005 | Le et al. | |
| 7,053,852 | B2 | 5/2006 | Timofeev et al. | |
| 7,283,101 | B2 * | 10/2007 | Bisiules et al. | 343/727 |
| 7,358,922 | B2 * | 4/2008 | Le et al. | 343/797 |
| 7,498,988 | B2 * | 3/2009 | Bisiules et al. | 343/700 MS |
| 7,535,430 | B2 * | 5/2009 | Le et al. | 343/797 |
| 2005/0179610 | A1 | 8/2005 | Le et al. | |
| 2006/0279471 | A1 | 12/2006 | Zimmerman | |
| 2008/0231528 | A1 | 9/2008 | Guixa Arderiu | |

FOREIGN PATENT DOCUMENTS

EP 0 994 524 A1 4/2000

OTHER PUBLICATIONS

PCT International Search Report corresponding International Application No. PCT/US2009/066016 filed Nov. 27, 2009.
PCT Written Opinion of the International Searching Authority corresponding International Application No. PCT/US2009/066016 filed Nov. 27, 2009.
Written Opinion for related case PCT/US2009/066016.

* cited by examiner

*Primary Examiner* — Hoang V Nguyen
(74) *Attorney, Agent, or Firm* — Husch Blackwell LLP

(57) ABSTRACT

A high band element and an antenna including a plurality of high band elements are provided. The high band element can include directors disposed above four dipoles, and the antenna can include a plurality of low band elements configured to accommodate the plurality of high band elements. The low band elements can be configured in a 1-2-2-2-1 arrangement or a 2-2-2-2-1 arrangement.

19 Claims, 10 Drawing Sheets

DUAL BAND BASE STATION ANTENNA

CROSS-REFERENCE TO RELATED APPLICATIONS

The present invention claims priority to U.S. Provisional Patent Application No. 61/118,328 filed Nov. 26, 2008 titled "Dual Band Base Station Antenna."

FIELD OF INVENTION

The present invention relates generally to antennas. More particularly, the present invention relates to dual band base station antennas.

BACKGROUND

In many wireless communication systems, various elements can operate within different frequency bands. Accordingly, separate radiating elements are required for each band. To provide dedicated antennas for each element would require an unacceptably large number of antennas. It is thus desirable to provide a compact antenna within a single structure capable of servicing all required frequency bands.

Base station antennas for cellular communication systems generally employ array antennas to allow control of the radiation pattern. Due to the narrow band nature of arrays, it is desirable to provide an individual array for each frequency range. When antenna arrays are superposed in a single antenna structure, the radiating elements must be arranged within the physical geometrical limitations of each array while minimizing undesirable electrical interactions between the radiating elements.

In accordance with the above, dual band antennas have been developed. For example, U.S. Pat. No. 7,283,101 to Bisiules et al. entitled "Antenna Element, Feed Probe; Dielectric Spacer, Antenna and Method of Communicating With a Plurality of Devices" discloses a dual band module used in connection with an antenna array. U.S. Pat. No. 7,283,101 is hereby incorporated by reference.

It has been found that a dipole element is particularly suited to being used in combination with a ring because the dipole element has a relatively low area (as viewed in plan perpendicular to the ring), and extends out of the plane of the ring. These characteristics may reduce coupling between the elements.

FIG. 1 is an isometric view of a prior art dual band antenna 100. The antenna 100 provides a broadband operation with low inter-modulation. Further, the radiating elements have a relatively small footprint.

As seen in FIG. 1, a sheet aluminum tray can provide a planar reflector 101, and a pair of angled side walls 102. The reflector 101 can carry five dual band modules 103 and a printed circuit board (PCB) 104 on its rear face (not shown). Each dual band module 103 can include (1) a crossed dipole element (CDE) centered in a microstrip annular ring (MAR), and (2) an additional CDE.

The dual band antenna 100 shown of FIG. 1 is advantageous because the high band dipole can be placed inside of the low band ring element. This leads to a very compact package. However, this antenna configuration is only good for achieving an azimuth beam width of approximately 60-70 degrees. The antenna configuration shown in FIG. 1 is not applicable for achieving a 45 degree azimuth beam width.

Accordingly, antennas have been developed to achieve a 45 degree beam width. FIG. 2 is an isometric view of a prior art single band antenna 200. In the antenna 200 of FIG. 2, the low band elements are configured in two columns to achieve a 45 degree beam width. However, this configuration does not allow room for any high band elements. Accordingly, the azimuth side lobes achieved are high.

U.S. Pat. No. 6,924,776 to Le et al. entitled "Wideband Dual Polarized Base Station Antenna Offering Optimized Horizontal Beam Radiation Patterns and Variable Vertical Beam Tilt," U.S. Pat. No. 7,358,922 to Le et al. entitled "Directed Dipole Antenna," and U.S. Pat. No. 7,053,852 to Timofeev et al. entitled "Crossed Dipole Antenna Element" disclose examples of directed dipole designs. U.S. Pat. Nos. 6,924,776, 7,358,922, and 7,053,852 are hereby incorporated by reference. In known directed dipole designs, directors have been disposed above a single crossed dipole.

For example, FIG. 3 is a perspective view of a prior art radiator element. As seen in FIG. 3, four dipole directors 40 are disposed above a single radiating element 14.

In view of the above, there remains a continuing, ongoing need for a dual band antenna that achieves a 45 degree azimuth beam width. Preferably, such an antenna includes both high band and low band elements in a compact package.

SUMMARY OF THE INVENTION

According to the present invention, a high band element is provided. The high band element can include four radiating elements, and at least one director disposed proximate to the four radiating elements. Each of the four radiating elements can generate a beam such that the high band element generates a beam with an approximate 45 degree pattern.

At least one of the four radiating elements can include a dipole element, or each of the four radiating elements can include a dipole element. At least one director can be disposed above the four radiating elements.

The high band element can include at least four directors disposed proximate the four radiating elements. At least two of the elements can be parallel to one another. At least some of the directors can be uniformly spaced from one another, and at least one of the directors can be spaced closer to at least one of the radiating elements than an adjacent director.

According to the present invention, an antenna is also provided. The antenna can include a plurality of low band elements, and a plurality of high band elements. The low band elements can be configured to accommodate the plurality of high band elements in a central area between the low band elements. The antenna can generate a 45 degree azimuth pattern.

The plurality of low band elements can be configured in a 1-2-2-2-1 arrangement or in a 2-2-2-2-1 arrangement. At least some of the low band elements can include a ring. At least some of the high band elements can include four radiating elements and at least one director disposed proximate to the four radiating elements. At least one director can be disposed above the four radiating elements.

The 45 degree azimuth pattern generated by the antenna can include a low first side lobe. The antenna can also generate a 45 degree elevation pattern. The 45 degree elevation pattern generated by the antenna can include a low first side lobe for low band elements and a low far side lobe for high band elements. The antenna can include first and second baffles extending along the length of each side of the antenna.

According to the present invention, a dual band antenna is also provided. The dual band antenna can include a plurality of low band elements operating at a frequency of approximately 824-896 MHz, and a plurality of high band elements operating at a frequency of approximately 1850-1990 MHZ. The dual band antenna can generate an approximate 45 degree azimuth beam pattern.

DESCRIPTION OF THE PREFERRED EMBODIMENTS

Figure 1:
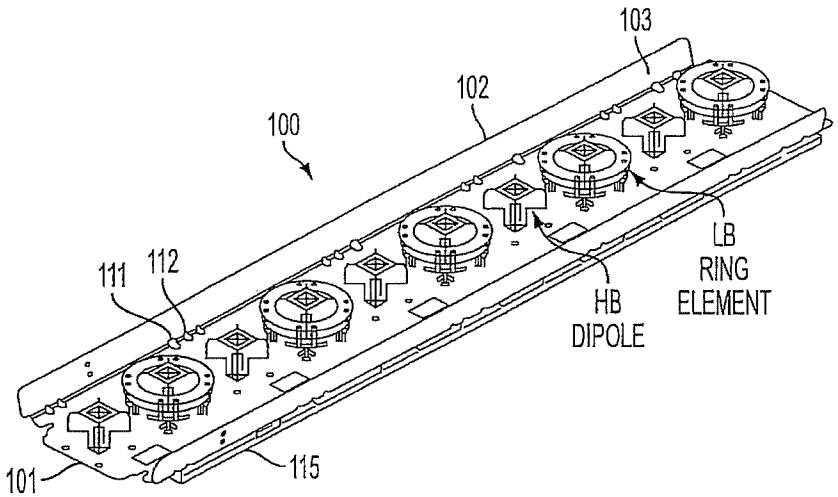
FIG. 1 is an isometric view of a prior art dual band antenna.
Figure 2:
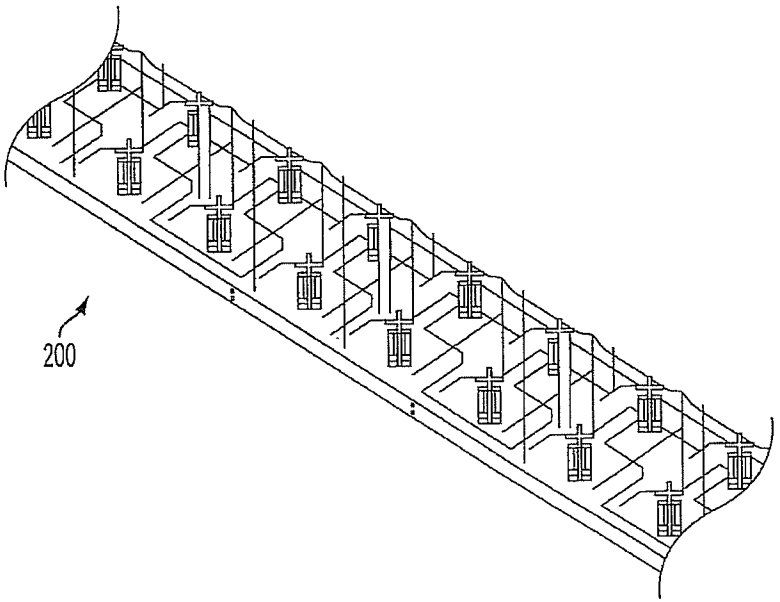
FIG. 2 is an isometric view of a prior art single band antenna.
Figure 3:
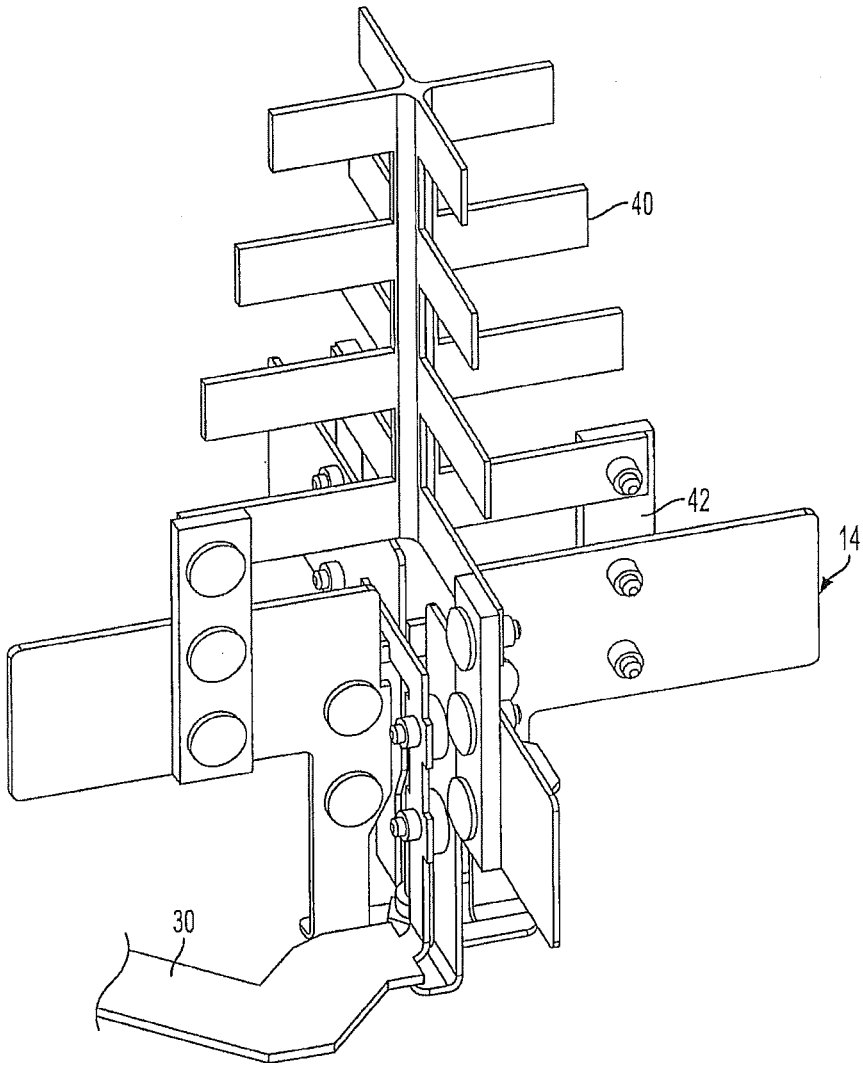
FIG. 3 is a perspective view of a prior art radiator element.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Embodiments of the present invention include an improved high band element or dipole. The high band element can include directors disposed above four dipoles. In accordance with the present invention, the high band element can be compact and can achieve a 45 degree pattern.

In further embodiments of the present invention, the improved high band element in accordance with the present invention can be incorporated into an antenna. The antenna can be configured to include both low band elements and improved high band elements in accordance with the present invention. For example, the low band elements can be placed in a 1-2-2-2-1 configuration. That is, the low band elements can be configured as a single element, two elements across from one another, two elements across from one another, two elements across from one another, and another single element.

In the central area, the distance between the low band antennas can be increased to accommodate the improved high band elements. Additionally, the two single low band elements can be spaced from the other elements of the antenna to reduce and/or minimize first side lobes and the grating lobe.

In accordance with the present invention, a stable 45 degree azimuth pattern can be achieved with low side lobes in the azimuth and elevation directions. Further, the number of elements included in an antenna in accordance with the present invention can be reduced and a compact design can be achieved having a low profile and width.

Further embodiments of the present invention include an antenna having low band elements placed in a 2-2-2-2-1 configuration. That is, the low band elements can be configured as two elements across from one another, two additional elements across from one another, two additional elements across from one another, two additional elements across from one another, and a single element. This configuration can provide additional room between the low band elements for placement of the high beam elements. Thus, lower azimuth side lobes can be achieved, and the low beam element distortions of the high beam element can be avoided.

Figure 4B:
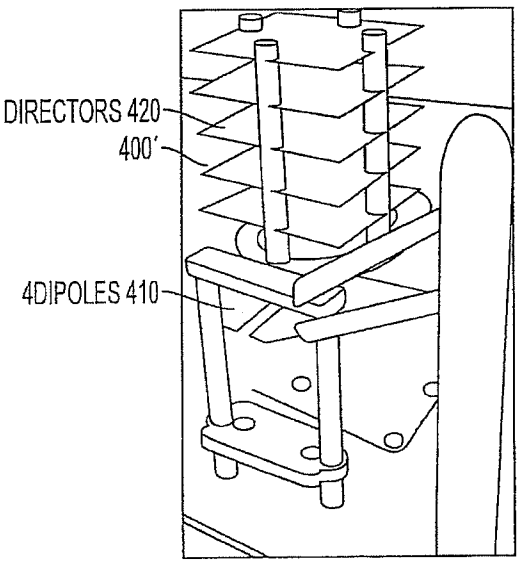
FIG. 4B is a perspective view of a second high band element in accordance with the present invention.
Figure 4A:
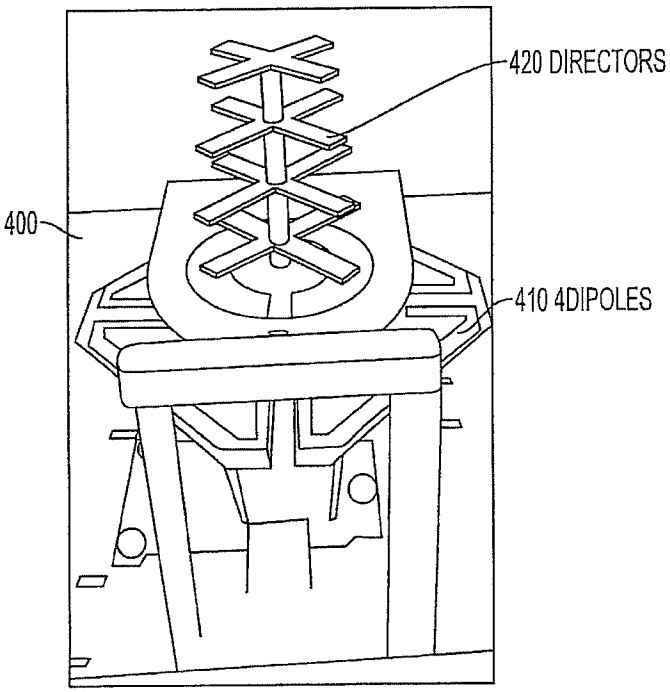
FIG. 4A is a perspective view of a first high band element in accordance with the present invention.

FIG. 4A is a perspective view of a first high band element 400, and FIG. 4B is a perspective view of a second high band element 400' in accordance with the present invention. Each of the high band elements 400 and 400' include four radiating elements, for example, dipoles 410. N laterally extending broadband cross dipole directors 420 can be disposed above the dipoles 410. N is 1, 2, 3, 4 . . . where N is four in the embodiments shown in FIGS. 4A and 4B.

When high band elements are configured as shown in FIGS. 4A and 4B, the high band element 400 or 400' can create a 45 degree pattern. Further, the high band element 400 or 400' can be compact in size.

Figure 5:
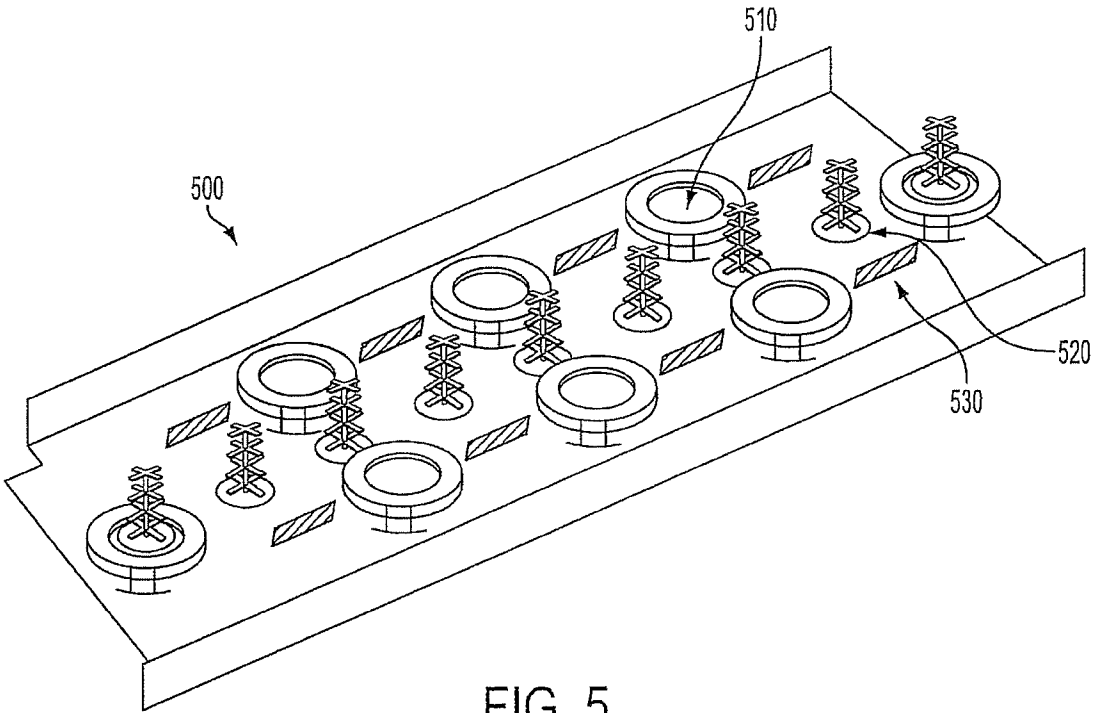
FIG. 5 is an isometric view of a first dual band antenna in accordance with the present invention.

FIG. 5 is an isometric view of a first dual band antenna 500 in accordance with the present invention. The antenna 500 can include a plurality of low band elements 510, for example, rings as disclosed in described in U.S. Pat. No. 7,283,101, which is hereby incorporated by reference. The low band rings 510 can be located in a 1-2-2-2-1 configuration, as seen in FIG. 5. In this configuration, the central area between the low band rings 510 is increased.

In the configuration shown in FIG. 5, high band elements 520 can be placed in the central area between the low band rings 510. In embodiments of the present invention, at least some of the high band elements 520 included in the antenna 500 can include a high band element 400 or 400' described above, which include directors disposed above four dipoles.

In some embodiments, the two single low band rings can have a different spacing than the rest of the low band rings. In other embodiments, a high band element 400 or 400' can be centered in each of the single low band rings. Adjusting the spacing of the single low band rings can reduce the first side lobes and the grating lobe.

The antenna 500 can also include baffles 530 or passive dipoles extending along the length of each side of the antenna 500. In embodiments of the present invention, the baffles can be segmented to accommodate the low band rings 510. The baffles can help to form a 45 degree pattern for the high band elements.

In accordance with the present invention, the antenna 500 shown in FIG. 5 can achieve a stable 45 degree azimuth pattern with low azimuth and elevation side lobes. Further, the number of elements included in the antenna 500 is reduced so that a compact design is achieved.

Figure 6:
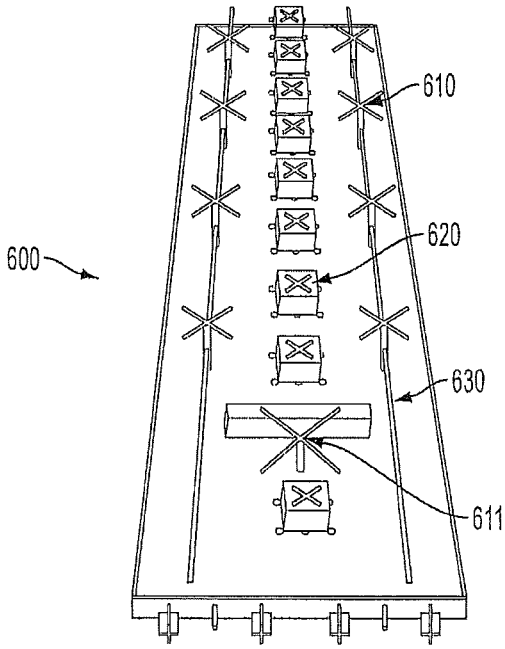
FIG. 6 is a front perspective view of a second dual band antenna in accordance with the present invention.

FIG. 6 is a front perspective view of a second dual band antenna 600 in accordance with the present invention. The antenna 600 can include a plurality of low band elements 610. However, as seen in FIG. 6, the low band elements 610 of the antenna 600 can be placed in a 2-2-2-2-1 configuration. This configuration can produce better azimuth side lobes.

In some embodiments, the distance between the single low band element 611 is not equal to the distance between the other low band elements. Adjusting the distance of the single low band element 611 allows for better side lobe suppression.

In the configuration shown in FIG. 6, the central area between the low band elements 610 is even greater to provide more room for high band elements 620. In some embodiments, at least some of the high band elements 620 can include a high band element 400 or 400' described above, which include directors disposed above four dipoles.

In some embodiments, the additional room between the low band elements 610 can accommodate additional high band elements 620. In addition to the greater room between the low band elements 610, the directors associated with the high band elements 620 can ensure that the low band elements 610 do not distort the high band pattern emitted from the antenna 600.

The antenna 600 can also include baffles 630 extending along the length of the antenna 600. The baffles 630 can help to form a 45 degree pattern for the high band elements.

Figure 7:
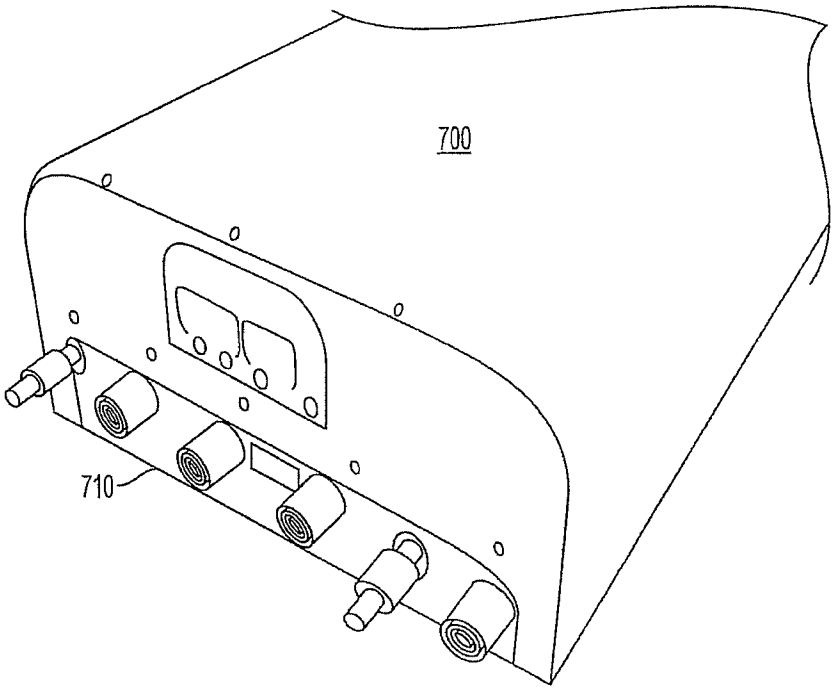
FIG. 7 is an end perspective view of a dual band antenna in accordance with the present invention.

FIG. 7 is an end perspective view of a dual band antenna 700 in accordance with the present invention. A plurality of ports 710 can be disposed at an end of the antenna. At least some of the ports can be input ports, and at least some of the ports can be output ports.

Figure 8:
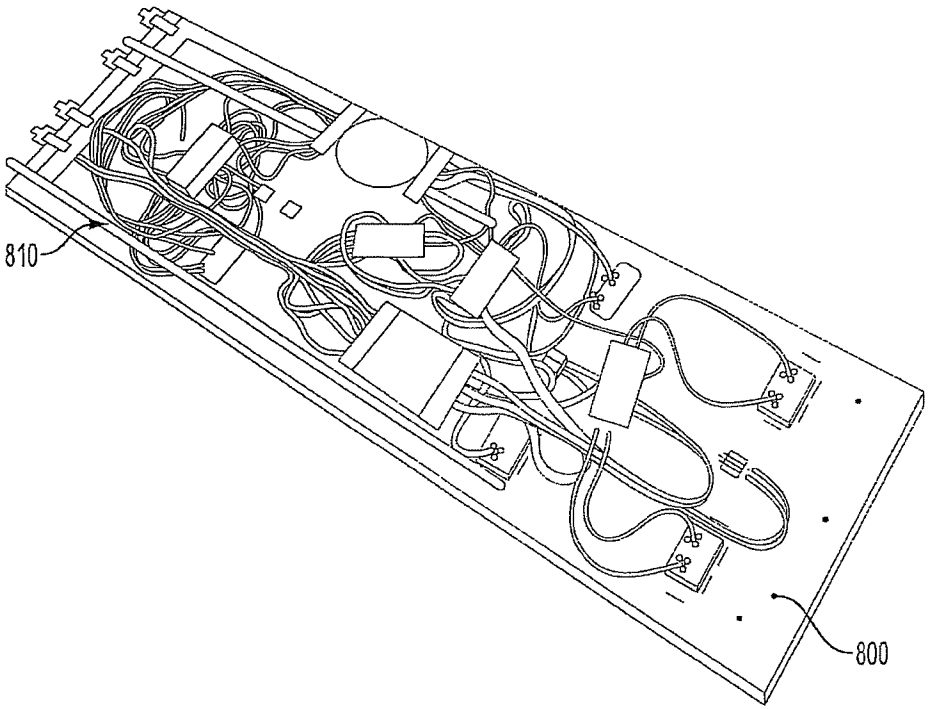
FIG. 8 is a back perspective view of a dual band antenna in accordance with the present invention.

FIG. 8 is a back perspective view of a dual band antenna 800 in accordance with the present invention. The back side of the antenna 800 includes a cable feed network of the antenna 800.

In accordance with the present invention, antennas and high band elements shown and described herein can achieve a 45 degree azimuth beam width. Further, the number of high band elements can be reduced by approximately 50-60%, and the number of low band elements can be reduced by approximately 20% as compared to known antenna systems. Table 1 indicates results achieved by antennas and high band elements in accordance with the present invention as compared to specification requirements.

TABLE 1

| | Spec. | | Invention Results | |
|---|---|---|---|---|
| Frequency (MHz) | 824-896 | 1850-1990 | 824-896 | 1850-1990 |
| Gain(dBi) | 15.5 | 17.5 | 15.2-16.2<br>15.7 mean | 17.0-18.6<br>17.8 mean |
| Azimuth BW (Deg.) | 45 | 45 | 43.2-48.2<br>44.4 mean | 39.3-51.6<br>43.6 mean |
| X-pol ratio over sector (dB) | 10 | 10 | >9.3<br>14.1 mean | >10.2 |
| X-pol ratio @ bore sight (dB) | 12 | 12 | >13.5 | >18 |
| F/B @ 180 (dB) | 25 | 30 | >24<br>28.5 mean | ?31<br>35.5 mean |
| Front-to-Side (dB) | 18 | 18 | >18 | >24 |
| Elevation BW (Deg.) | 15 | 7 | 15.6-17.2<br>16.5 mean | 6.5-7.6<br>7.0 mean |
| USLS (dB) $1^{st}$ | 15 | 15 | >14.9<br>22.7 mean | >14.2<br>20.7 mean |
| Beam Tilt (Deg.) | 0-12 | 0-10 | 0-16 | 0-10 |
| Return Loss (dB) | >14 | >14 | >14.6 | >16.2 |
| PIM3 @ 2 × 20 w (dBc) | <−150 | <−150 | −150.3 | −150.4 |
| Iso (dB) In-Band | 30 | 30 | >30 | >30 |
| Iso (dB) Cross-Band | >15 | >15 | >18 | >24 |
| Max Input Power @20 | 300 | 250 | 500 | 250 |

TABLE 1-continued

| | Spec. | Invention Results |
|---|---|---|
| L × W × D (mm) | 1320 × 285 × 175 | 1320 × 289 × 145 |
| Weight (kg) | 15 | 13.6 |

Figure 9:
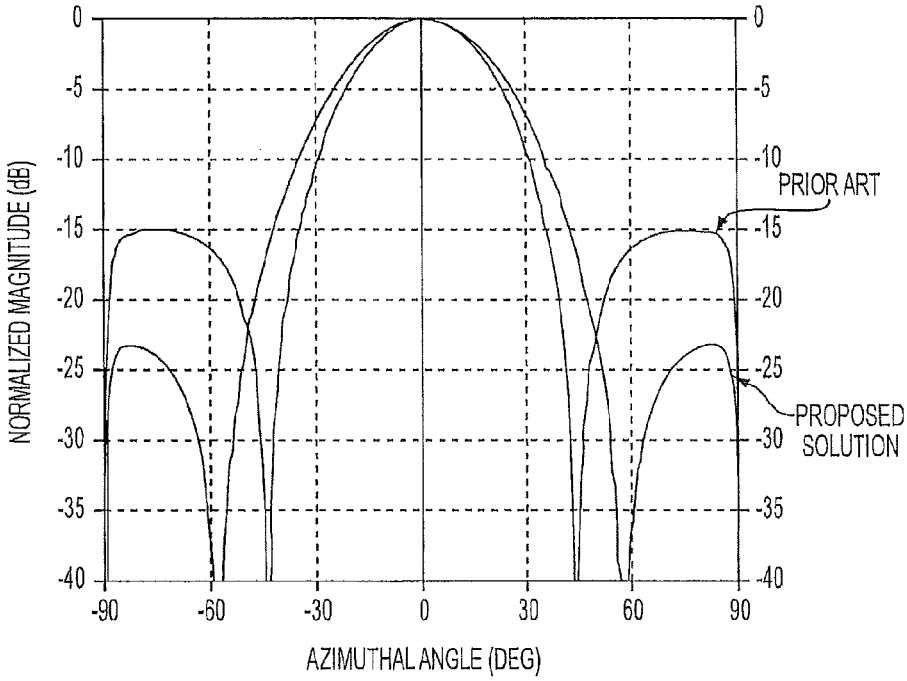
FIG. 9 is a graph depicting improvements in the azimuth side lobe levels when an antenna in accordance with the present invention is employed.

FIG. 9 is a graph depicting improvements in the azimuth side lobe levels when an antenna in accordance with the present invention is employed. The improvements depicted in FIG. 9 can be achieved by using a 1-2-2-2-1 configuration as shown in FIG. 5 or using a 2-2-2-2-1 configuration as shown in FIG. 6. As seen in FIG. 9, the level of the azimuth side lobe is decreased when an antenna in accordance with the present invention is employed.

Figure 10B:
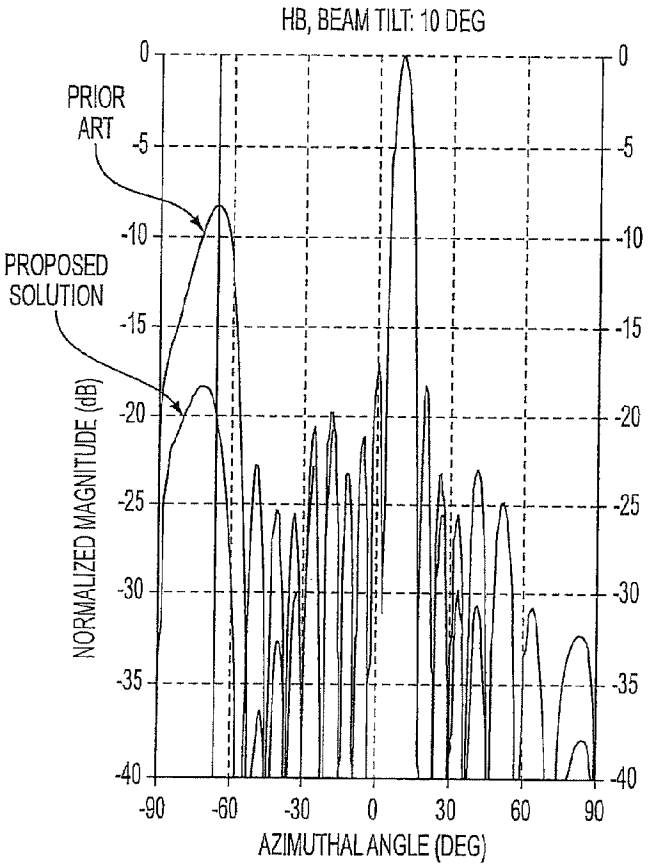
FIG. 10B is a graph depicting improvements in the far elevation side lobe level for high band elements when an antenna in accordance with the present invention is employed.
Figure 10A:
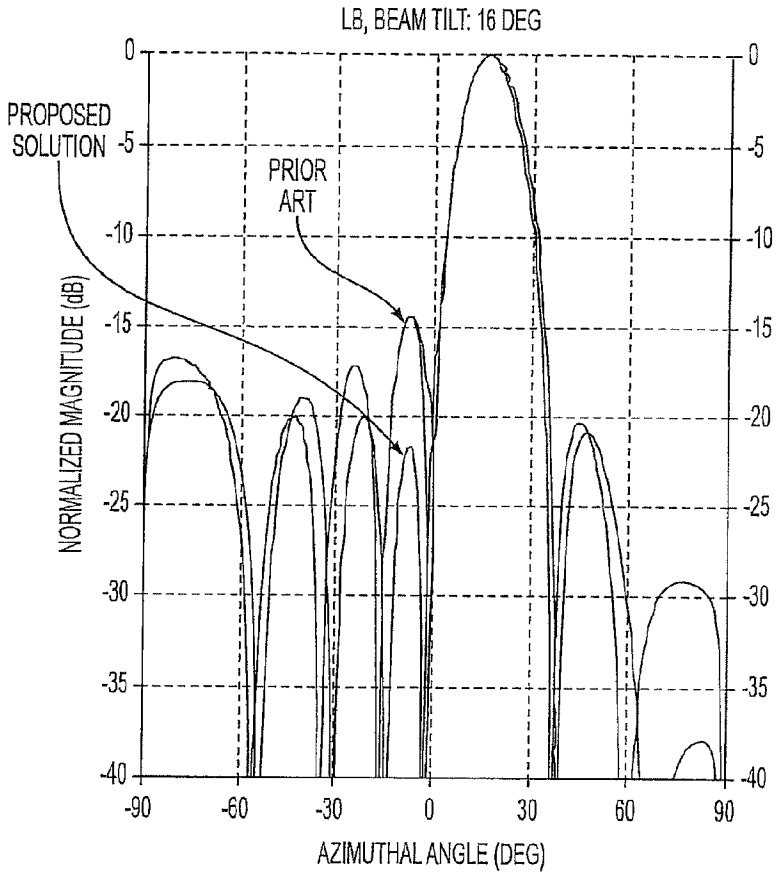
FIG. 10A is a graph depicting improvements in the first elevation side lobe level for low band elements when an antenna in accordance with the present invention is employed.

FIG. 10A is a graph depicting improvements in the first elevation side lobe level for low band elements when an antenna in accordance with the present invention is employed. As seen in FIG. 10A, the level of the first elevation side lobe for a low band element is decreased when an antenna in accordance with the present invention is employed.

FIG. 10B is a graph depicting improvements in the far elevation side lobe level for high band elements when an antenna in accordance with the present invention is employed. As seen in FIG. 10B, the level of the far elevation side lobe for a high band element is decreased when an antenna in accordance with the present invention is employed.

From the foregoing, it will be observed that numerous variations and modifications may be effected without departing from the spirit and scope of the invention. It is to be understood that no limitation with respect to the specific system or method illustrated herein is intended or should be inferred. It is, of course, intended to cover by the appended claims all such modifications as fall within the sprit and scope of the claims.

What is claimed is:

1. A high band element comprising:

four radiating elements in a single footprint; and at least one director in the single footprint, wherein the at least one director is disposed proximate to the four radiating elements, and wherein each of the four radiating elements generates a beam such that the high band element generates a beam with an approximate 45 degree pattern.

2. The high band element of claim 1 wherein at least one of the four radiating elements includes a dipole element.

3. The high band element of claim 1 wherein each of the four radiating elements includes a dipole element.

4. The high band element of claim 1 wherein at least one director is disposed above the four radiating elements.

5. The high band element of claim 1 wherein at least four directors are disposed proximate to the four radiating elements.

6. The high band element of claim 5 wherein at least two of the directors are parallel to one another.

7. The high band element of claim 5 wherein at least some of the directors are uniformly spaced from one another.

8. The high band element of claim 7 wherein at least one of the directors is spaced closer to at least one of the radiating elements than an adjacent director.

9. An antenna comprising:

a plurality of low band elements; and a plurality of high band elements, wherein at least some of the high band elements include four radiating elements in a single footprint and at least one director in the single footprint, the at least one director disposed proximate to the four radiating elements, wherein the low band elements are configured to accommodate the plurality of high band elements in a central area between the low band elements, and wherein the antenna generates a 45 degree azimuth pattern.

10. The antenna of claim 9 wherein the plurality of low band elements are configured in a 1-2-2-2-1 arrangement.

11. The antenna of claim 9 wherein at least some of the low band elements include a ring.

12. The antenna of claim 9 wherein the at least one director is disposed above the four radiating elements.

13. The antenna of claim 9 wherein the 45 degree azimuth pattern generated by the antenna includes a low first side lobe.

14. The antenna of claim 9 wherein the antenna generates a 45 degree elevation pattern.

15. The antenna of claim 14 wherein the 45 degree elevation pattern generated by the antenna includes a low first side lobe for low band elements.

16. The antenna of claim 14 wherein the 45 degree elevation pattern generated by the antenna includes a low far side lobe for high band elements.

17. The antenna of claim 9 wherein the plurality of low band elements are configured in a 2-2-2-2-1 arrangement.

18. The antenna of claim 9 further comprising first and second baffles extending along the length of each side of the antenna.

19. A dual band antenna comprising:

a plurality of low band elements operating at a frequency of approximately 824-896 MHz; and a plurality of high band elements operating at a frequency of approximately 1850-1990 MHZ, wherein the dual band antenna generates an approximate 45 degree azimuth beam pattern, and wherein at least some of high band elements include four radiating elements in a single footprint and at least one director in the single footprint, the at least one director disposed proximate to the four radiating elements.

* * * * *